United States Patent [19]

Svihovec

[11] 4,079,606

[45] Mar. 21, 1978

[54] RING KEY

[76] Inventor: Robert G. Svihovec, Box 247 A, Kennebunkport, Me. 04046

[21] Appl. No.: 773,059

[22] Filed: Feb. 28, 1977

[51] Int. Cl.[2] ..... E05B 19/02

[52] U.S. Cl. ..... 70/402; 70/407

[58] Field of Search ..... 70/390, 402, 407, 396; 63/1 R, 15; D8/347, 348; D11/26, 27, 29, 30, 31, 37

[56] References Cited

U.S. PATENT DOCUMENTS 2,656,707 10/1953 Nilsson ..... 70/402

*Primary Examiner*—Robert L. Wolfe

[57] ABSTRACT

An ornamental, emergency key adapted to be worn as a ring comprising a head portion and a curved key portion extending from the head portion; said key portion having appropriate notches and indentations and being bendable into a flat form by being stepped on.

2 Claims, 4 Drawing Figures

RING KEY

SUMMARY OF INVENTION

The invention comprises generally a head portion which is usually ornamental from which extends a key-forming portion. The key-forming portion has the appropriate notches and indentations and is comprised of a bendable material. Most of the time the key-forming portion will be bent into a curve so as to be slidable on a finger, and with the head or ornamental portion, give the appearance of a ring.

When an emergency arises for use of the device as a key, the user slips it off his or her finger and presses the curved key-formed portion so as to make it flat by use of a simple tool or merely by stepping on it. After the key has served its emergency function, it can then be rebent into the ring curvature and worn again by the user on a finger. Depending on the material, such bending and rebending can be accomplished at least four or five times. Examples of suitable materials are ordinary brass and aluminum.

A suitable material for use in making the key-forming portion of this invention is one which has sufficient strength and coherence so as to be ground or cut into a key which can operate a lock. The thickness of such a material should be such that when formed into a key, it can fit into the lock and operate the lock. Another requirement of the material is that at its operable thickness, it is bendable at least once to form the ring and then at least bendable back once to form the key.

While it is preferred that the notches and indentations on the key-forming portion be made before that portion is curved to form the ring, the indentations can be formed by the purchaser by flatening, cutting and recurving.

BACKGROUND OF INVENTION

This invention relates to a novel emergency key.

Because of the increasing concern for security, locks and keys play an increasingly important part in the way we live. Whereas formerly houses, apartments and automobiles were left unlocked, it is now essential that all doors be securely looked at all times.

However, it is very common for an individual to forget or misplace a key. Various methods have been suggested in the past to remedy this situation, such as leaving extra keys with neighbors or friends or hiding keys under doormats or under automobile fenders. Such practices are, however, generally unsatisfactory.

One object of the present invention is to provide an energency key which is worn as a ring or finger ornament until there is need for its use.

Other objects and advantages of this invention will be apparent from the description and claims which follow taken together with the appended drawings.

SPECIFIC EXAMPLE OF INVENTION

Figure 1:
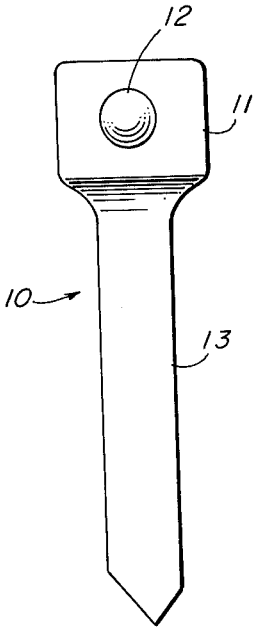
FIG. 1 illustrates a top view of the flat blank from which the invention is formed.
Figure 2:
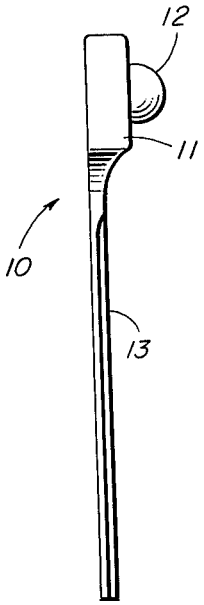
FIG. 2 is a side view of FIG. 1.

Referring now to the drawings, it is shown illustrate therein in FIG. 1 a blank 10 having an ornamental portion 11 and a key-forming portion 13. The ornamental portion 11 is generally made of an appropriate rigid material such as precious or semi-precious metal and in this instance has embedded therein an ornamental stone 12. The key-forming portion 13 can be formed of ordinary brass or aluminum and can be plated. The thickness of the key-forming portion 13 is such that it will be malleable, that is to say readily adpated to curve or vise versa by ordinary pressure, as for example by stepping on the end thereof.

Figure 3:
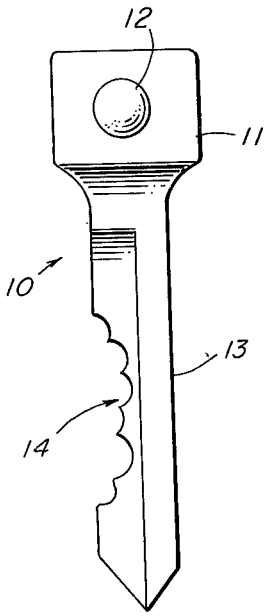
FIG. 3 is a view as in FIG. 1 in which appropriate key indentations have been made
Figure 4:
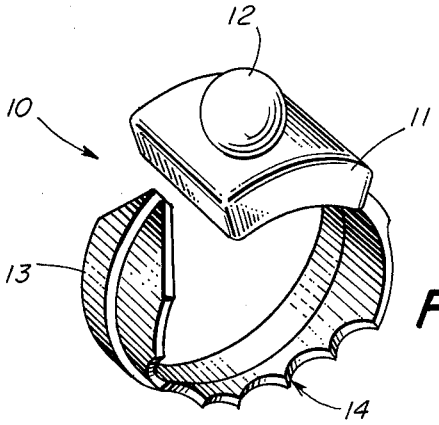
FIG. 4 is a perspective view showing the cut blank of FIG. 3 bent over into the form of a finger ring.

The key-forming portion 13 is then cut on a conventional key-forming machine to give the appropriate notches 14 and side indentations that are required for the lock in question, as shown in FIG. 3. This is then readily bent on a form to produce a ring as shown in FIG. 4, which is ornamental and can be worn on the finger as an emergence key.

When it is desired to use it as an emergency key, it is removed from the finger, the key portion flatened out and then inserted into the lock. Depending on the material, this can be done a number of times without breaking.

A typical thickness of the key-forming portion is 1/16 of an inch, which although somewhat thinner than conventional keys, will operate in a lock and is more readily returned to shape than a thicker key-forming portion.

I claim:

1. An ornamental device worn as a ring, comprising a head portion and a curved key-forming portion made of malleable material and extending from the head portion: said key-forming portion being formed into an operable key by making appropriate notches and indentations and bending into a flat form by the application of pressure, as for example, stepping thereon.

2. An ornamental, emergency key worn as a ring, comprising a head portion and a curved key portion made of malleable material and extending from the head portion; said key portion having appropriate notches and indentations and being bendable into a flat form by being stepped on so as to form an operable key.

* * * * *